US006590481B2

(12) United States Patent
Turner et al.

(10) Patent No.: US 6,590,481 B2
(45) Date of Patent: Jul. 8, 2003

(54) FAST ACTING, ELECTRICALLY POWERED OPERATOR FOR TRANSFER SWITCH AND TRANSFER SWITCH INCORPORATING SAME

(75) Inventors: David Curtis Turner, Imperial, PA (US); Jeffrey Lowell Woods, Pittsburgh, PA (US); David Michael Olszewski, McKees Rocks, PA (US); William Ellsworth Beatty, Jr., Brighton Township, PA (US); Ronald Dale Hartzel, Butler, PA (US)

(73) Assignee: Eaton Corporation, Cleveland, OH (US)

( * ) Notice: Subject to any disclaimer, the term of this patent is extended or adjusted under 35 U.S.C. 154(b) by 219 days.

(21) Appl. No.: 09/750,572

(22) Filed: Dec. 28, 2000

(65) Prior Publication Data

US 2002/0093405 A1 Jul. 18, 2002

(51) Int. Cl.[7] ..... H01H 9/20
(52) U.S. Cl. ..... 335/160; 335/159; 335/161; 335/68; 200/50.1
(58) Field of Search ..... 335/68–77, 159–162; 200/50.1–50.5; 307/114

(56) References Cited

U.S. PATENT DOCUMENTS

| | | | | |
|---|---|---|---|---|
| 4,167,716 A | | 9/1979 | Horn | |
| 4,553,115 A | | 11/1985 | Grunert et al. | |
| 4,691,180 A | * | 9/1987 | Grunert et al. | 335/6 |
| 4,804,933 A | | 2/1989 | Becker et al. | |
| 5,343,179 A | | 8/1994 | Pipich et al. | |
| 6,096,986 A | * | 8/2000 | Flegel | 200/50.33 |

OTHER PUBLICATIONS

Cutler–Hammer, "*I.L. 29C200E*", Nov., 1998, pp. 1–9.

* cited by examiner

*Primary Examiner*—Lincoln Donovan
(74) *Attorney, Agent, or Firm*—Martin J. Moran

(57) ABSTRACT

An electrically powered, fast acting transfer switch utilizes a single action solenoid that, alternately, through a mechanical assembly, moves the handle of one electric power switch between OFF and ON positions. A coupling including a rigid strap operates the handle of a second electric power switch oppositely between ON and OFF positions. The mechanical assembly includes an electromagnet drive plate to which the electromagnet of the solenoid is secured and an armature drive plate carrying the solenoid armature. A latch mechanism alternately holds one drive plate and then the other stationary so that the electromagnet and armature alternately move to effect reciprocal movement of the handle of the one electric power switch, and through the rigid strap, the handle of the second electric power switch.

7 Claims, 5 Drawing Sheets

FIG. 4
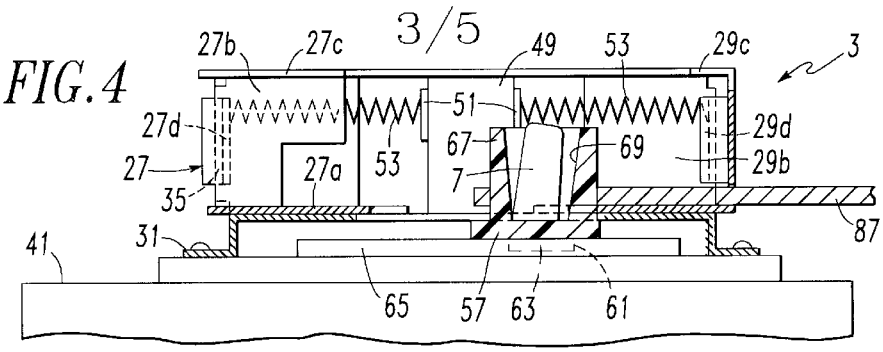
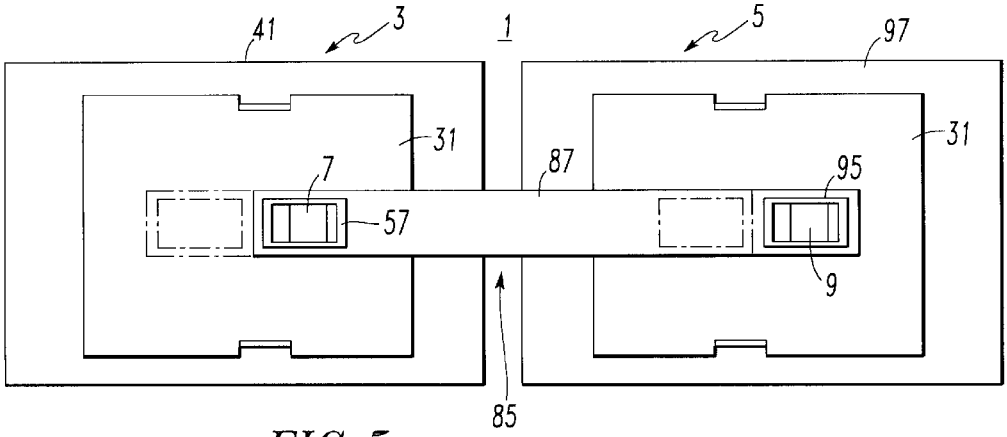
FIG. 5
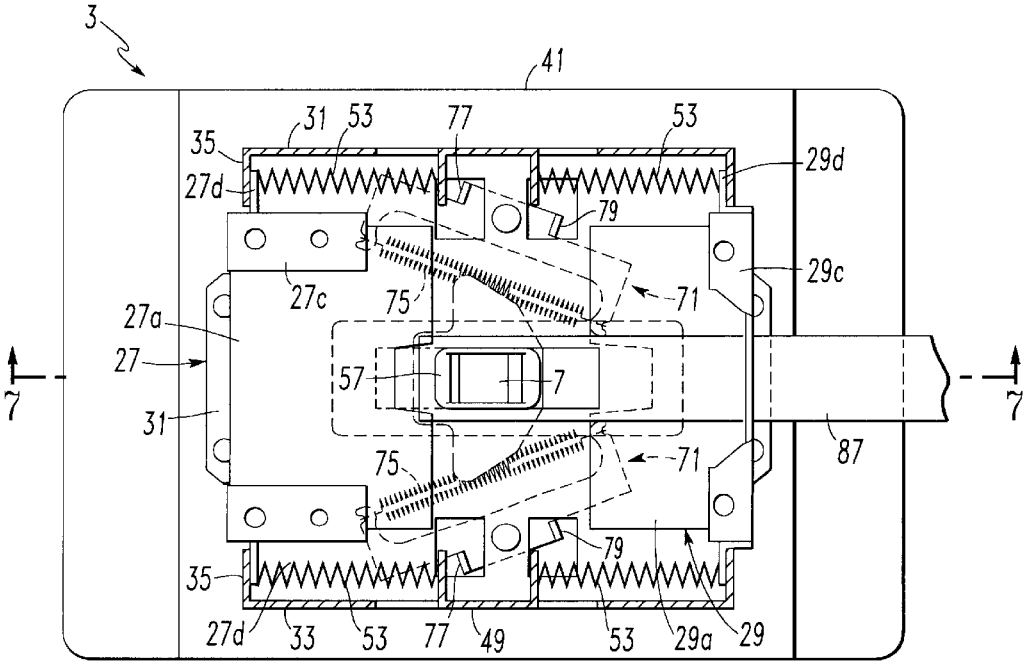
FIG. 6

FAST ACTING, ELECTRICALLY POWERED OPERATOR FOR TRANSFER SWITCH AND TRANSFER SWITCH INCORPORATING SAME

BACKGROUND OF THE INVENTION

1. Field of the Invention

This invention relates to switches for electric power distribution systems and, more particularly, to electrically powered operators for interlocking the operation of a pair of switches, such as those in a transfer switch.

2. Background Information

Transfer switches commonly used to connect alternate power sources to a load, including networks, utilize a pair of switches each connecting one of the sources to the load. In order to prevent connecting unsynchronized sources together, the operation of the two switches is coordinated, typically by a mechanical interlock, so that only one switch at a time can be turned ON. In many instances, it is desirable to operate the transfer switch remotely. Typically, electric motors have been used to operate the interlocks on transfer switches. The motor powered interlocks operate relatively slowly so that there is a noticeable dead period between the time that one of the switches is turned OFF and the other is turned ON. It is desirable to minimize this dead period while assuring that the two switches are never both ON at the same time.

U.S. Pat. No. 4,553,115 describes a solenoid powered operator for a single, molded case circuit breaker. This device operates the circuit breaker handle rapidly each time the solenoid is energized. It would be desirable to be able to operate the pair of switches in a transfer switch at a similar rapid rate, thereby reducing the interval in which the load is unenergized.

There is a need, therefore, for an improved operator for the switches of a transfer switch which allows the transfer to be made more rapidly.

SUMMARY OF THE INVENTION

This need, and others, are satisfied by the invention which is directed to a fast acting, electrically powered operator for a pair of electric power switches and to a transfer switch incorporating this operator. The switches of a transfer switch are mounted end to end with their handles oppositely reciprocable in a common plane between OFF and ON positions. The electrically powered operator comprises a solenoid, and a mechanical assembly coupling the solenoid to the handle of the first switch for reciprocating the handle between the ON and OFF positions on successive actuations of the solenoid. A coupling comprising an elongated member couples the handle of the second switch to the handle of the first switch for movement therewith to reciprocate the handle of the second switch between the OFF position and the ON position opposite to the ON position and OFF position of the handle of the first switch.

The solenoid is a single action solenoid having an electromagnet and an armature movable relative to the electromagnet. The mechanical assembly includes a first drive member coupled to the electromagnet and a second drive member coupled to the armature. A latch mechanism reciprocates between a first latch position in which the first drive member is held fixed and the second drive member moves upon actuation of the single action solenoid, and a second latch position in which the second drive member is held fixed and the first drive member moves upon actuation of the single action solenoid. A first yoke engages the first handle to reciprocate the first handle between the ON and OFF positions on successive actuations of the single action solenoid through alternate engagement by one and then the other of the first and second drive members. The first yoke engages and toggles the toggle mechanism as the first handle reciprocates between the ON and OFF positions. The elongated member of the coupling is coupled to the first yoke. A second yoke connects the elongated member to the second handle. The coupling includes a guide mounted on the second switch guiding the reciprocal movement of the elongated member and maintaining the second yoke in engagement with the second handle. The mechanical assembly includes a frame mounted on the first switch and within which the first and second drive members reciprocate. The frame includes a guide in the form of a slot for guiding reciprocal movement of the elongated member and maintaining the elongated member in engagement with the first handle through the first yoke.

The invention also embraces the fast acting, electrically powered operator for a pair of end mounted electric power switches.

BRIEF DESCRIPTION OF THE DRAWINGS

A full understanding of the invention can be gained from the following description of the preferred embodiments when read in conjunction with the accompanying drawings in which:

FIG. 4 is a vertical section through FIG. 3 taken along the line 4—4;

FIG. 5 is a simplified plan view illustrating that with the switch shown in FIGS. 2 and 3 in the OFF position, the other switch is in the ON position;

FIG. 6 is a horizontal sectional view similar to FIG. 3 but with the associated switch in the ON position;

DESCRIPTION OF THE PREFERRED EMBODIMENTS

Figure 1:
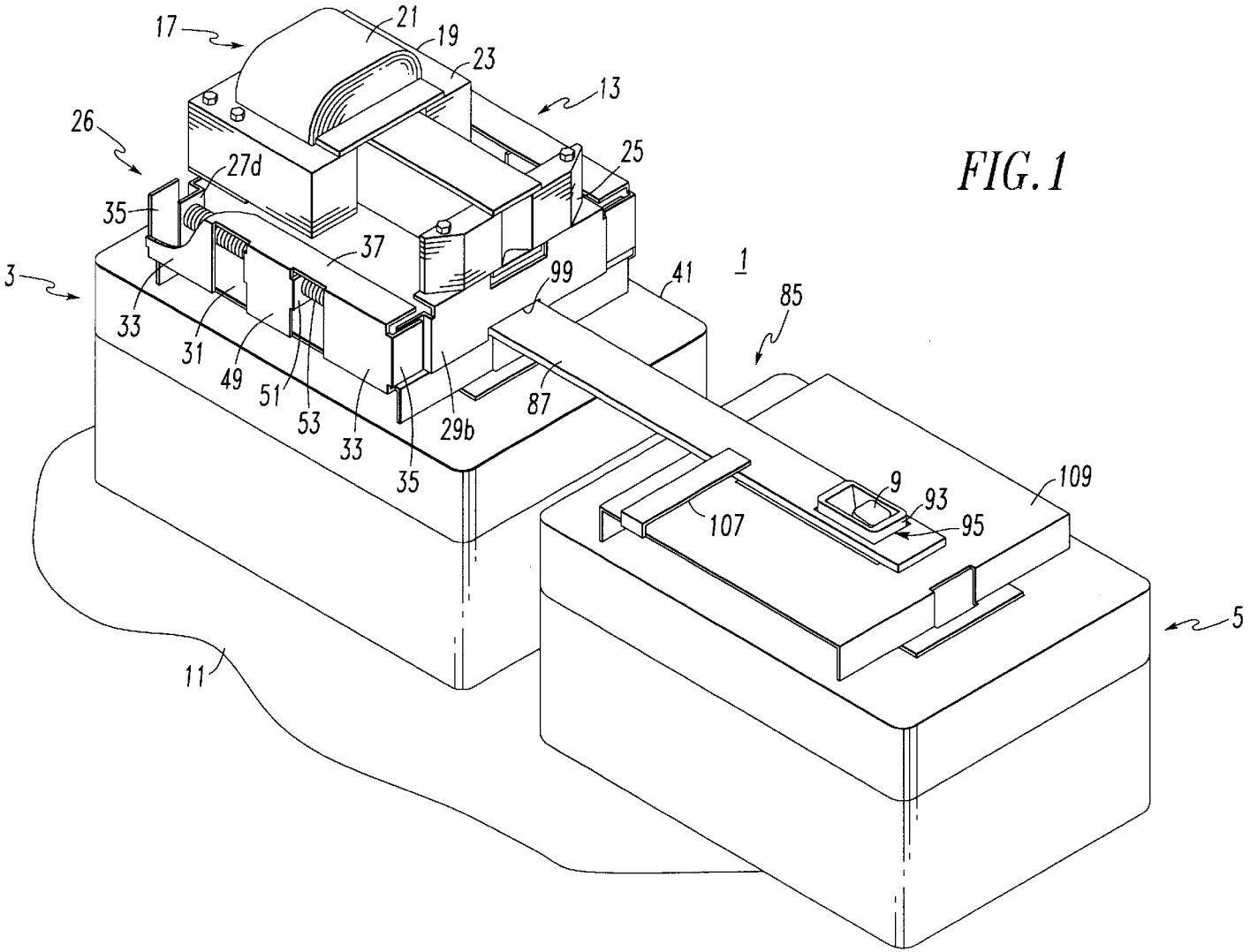
FIG. 1 is an isometric view of a transfer switch incorporating the invention.

FIG. 1 illustrates a transfer switch 1 which incorporates a pair of electric power switches 3 and 5. These electric power switches 3 and 5 can be molded case switches, which are well known in the power distribution field. If overcurrent protection is desired, the switches 3 and 5 can be circuit breakers. Referring also to FIG. 5, the switches 3 and 5 have handles 7 and 9, respectively, which move rectilinearly between ON and OFF positions, as is well known. The two switches 3 and 5 are mounted end to end, such as on a panel board 11, with the handles 7 and 9 movable in a common plane. The switches 3 and 5 are oppositely oriented so that with the handles 7 and 9 turned in the same direction, one switch is ON and the other is OFF.

Figure 2:
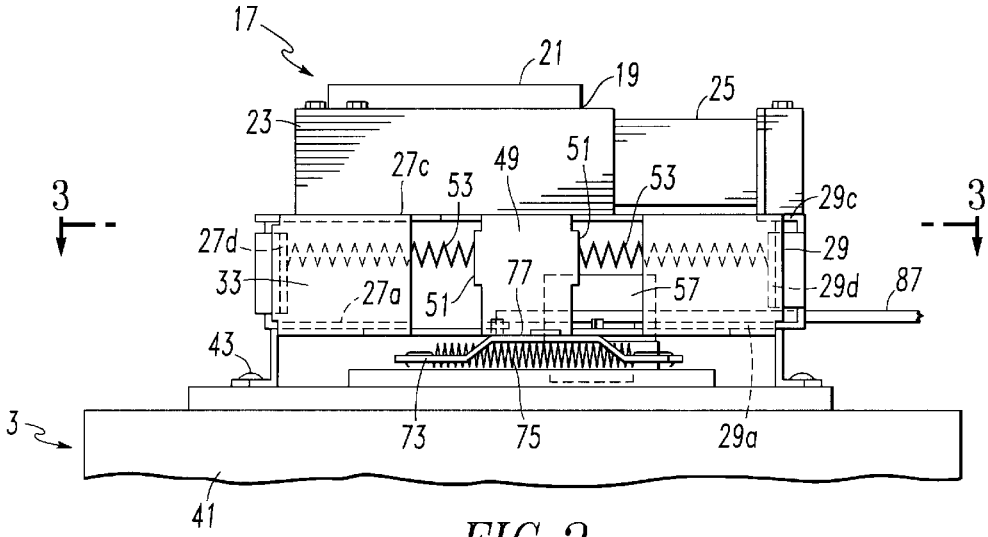
FIG. 2 is a side elevation view of a portion of the transfer switch of FIG. 1 showing the mechanical assembly with the associated switch in the OFF position.
Figure 3:
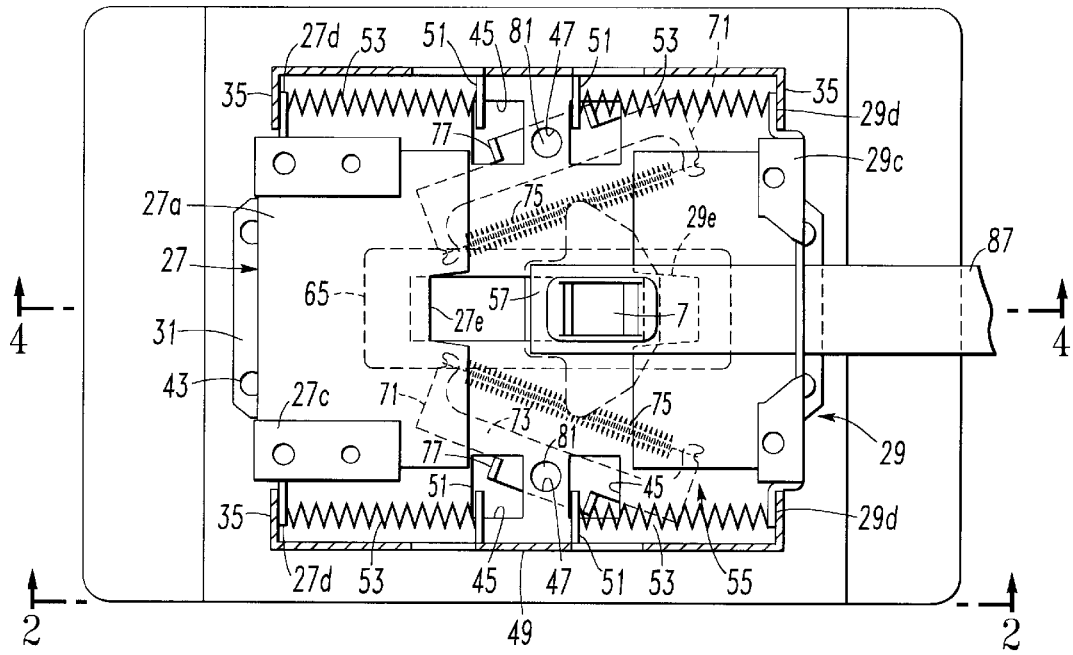
FIG. 3 is a horizontal section through the mechanical assembly shown in FIG. 2 taken along the line 3—3.
Figure 9:
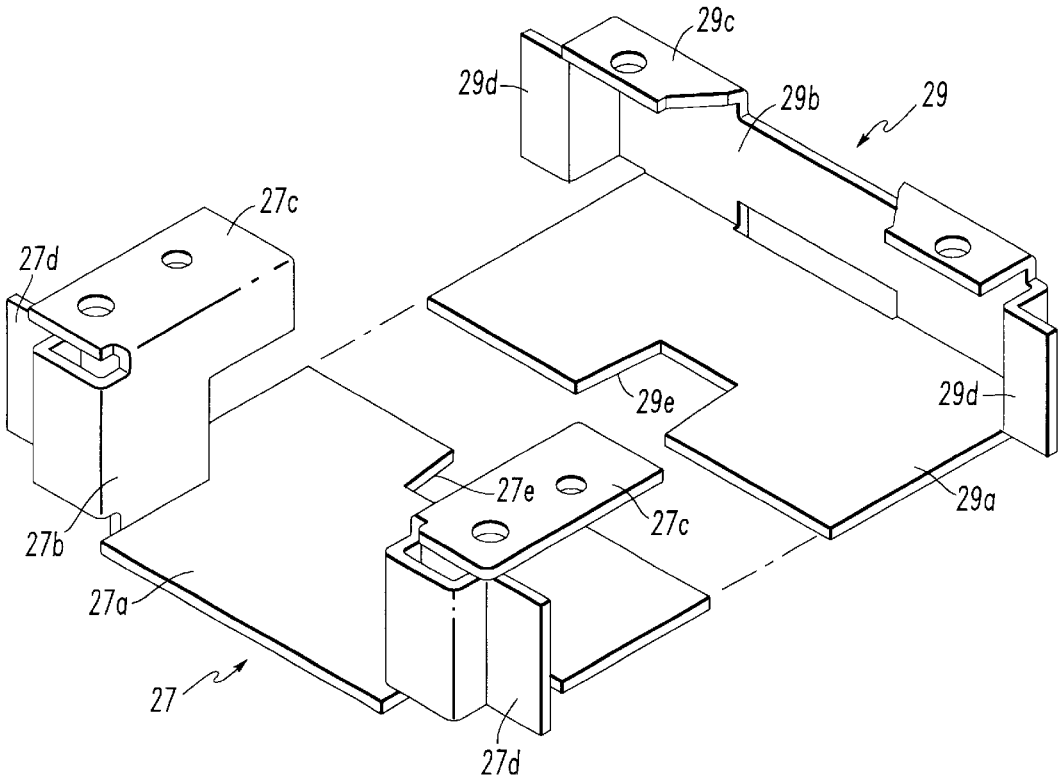
FIG. 9 is an isometric view of the electromagnet and armature drive plates that form part of the mechanical assembly of the transfer switch.

Opposite rectilinear movement of the handles 7 and 9 is effected by an electrically powered operator 13. Referring to FIGS. 2 through 4, the electrically powered operator 13 incorporates a single action solenoid 17 which includes an electromagnet 19 having a single electrical coil 21 wound on a magnetic core 23 and a generally T-shaped armature 25 that is movable with respect to and within the electromagnet 19. The solenoid 17 is coupled to the handle 7 of the switch 3 by a mechanical assembly 26. This mechanical assembly 26 includes a first drive member in the form or an electromagnet drive plate 27 that is secured to the electromagnet 19 and mounted for rectilinear movement along the axis of movement of the handle 7. The armature 25 is secured to a second drive member in the form of an armature drive plate 29 that is also disposed for rectilinear movement along the axis of movement of the handle 7 but on the opposite side of the handle from the electromagnet drive plate 27. The electromagnet drive plate 27 slides on a mounting plate or frame 31 and is contained by side flanges 33, end flanges 35 and top flanges 37 formed by the mounting plate 31. Referring to FIG. 9, the electromagnet drive plate 27 has a flat base section 27*a*, upstanding side flanges 27*b* and horizontal terminal flanges 27*c* on which the electromagnetic is mounted. Offset end flanges 27*d* are aligned with the end flanges 35 on the mounting plate 31.

Similarly, the armature drive plate 29 slides on the mounting plate 31 and is contained by sides flanges 33, end flanges 35 and top flanges 37. The armature drive plate 29, as shown in FIG. 9, has a flat base section 29*a*, a vertical flange 29*b*, a horizontal terminal flange 29*c* on which the armature is mounted and offset end flanges 29*d* aligned with end flanges 35 on the mounting plate 31.

The mounting plate 31 is secured to the top of the molded housing 41 of the switch 3 by fasteners 43. The mounting plate 31 includes four rectangular latch slots 45 and a pair of latch pivot center apertures 47. The mounting plate 31 also includes, at the center of each side, an integrally formed, upstanding spring bracket 49 each having a pair of integrally formed, inwardly bent rigid ears 51 for engaging the ends of four helical compression springs 53. These helical compression springs 53 bear against offset end flanges 27*d* of the electromagnet drive plate 27 or the offset ends 29*d* of the armature drive plate 29, as seen in FIGS. 2–4, to bias the drive plates 27 and 29 to their limit positions.

Figure 8:
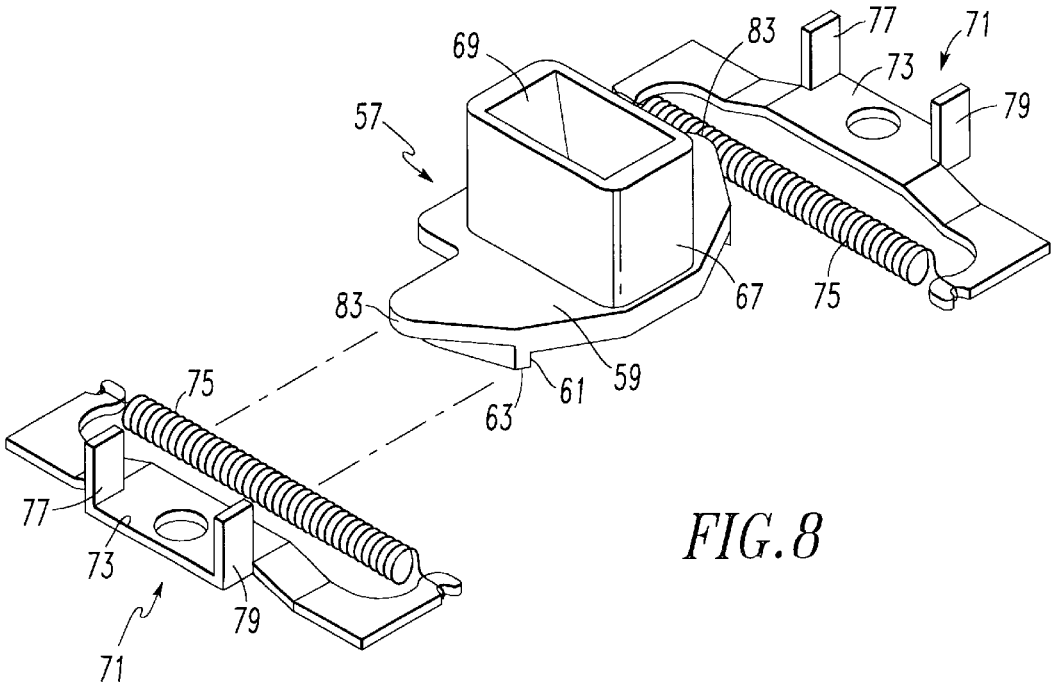
FIG. 8 is an isometric view of the toggle mechanism which forms part of the mechanical assembly.

The mechanical assembly 26 incorporates a latch mechanism 55. Referring also to FIG. 8, this latch mechanism 55 includes a first yoke 57 which comprises a base 59 having a transverse slot 61 in a bottom face 63 that seats on an escutcheon 65 on the molded housing 41 of the switch 3 surrounding the handle 7. The yoke 57 has an upstanding collar 67 with a through aperture 69 in which the handle 7 is captured. As will be seen, the electromagnet drive plate 27 and the armature drive plate 29 bear against opposite sides of the yoke 57 to drive the handle 7 between the ON and OFF positions.

Latch mechanism 55 also includes a pair of pivotable, bistable mechanical spring latches 71 configured to alternately engage and stop further movement of the electromagnet drive plate 27 and the armature drive plate 29. Each of the spring latches 71 includes a latch arm 73 and a helical tension spring 75 stretched between the ends of the latch arm 73. The latch arms 73 have stops 77 and 79 integrally formed at opposite ends that extend through the latch slots 45 in the mounting plate 31 and are configured to engage and stop the movement of the electromagnetic drive plate 27 and the armature drive plate 29, respectively. The latch arms 73 are mounted for pivotable movement beneath the mounting plate 31 by pivot rivets 81 engaging the latch pivot apertures 47.

The yoke 57 includes, at the laterally outward ends of the base 59, latch camming surfaces 83 which engage and laterally deflect the tension springs 75 on the latch arms 73. The latch arms 73 have two stable positions. In the first stable position, shown in FIG. 3, the latch arms 73 are rotated so that the stops 77 are in position to engage and limit the movement of the electromagnet drive plate 27. In the second stable position, the latch arms 73 are rotated to the positions, shown in FIG. 6, where the stops 79 are rotated inward to form stops for and set the limit of travel of the armature drive plate 29. The bistable latch arms 73 rapidly transfer between the two stable positions by movement of the camming surfaces 83 on the base 59 of the yoke 57 from one side to the other of the pivot axes of the latch arms 73 as the yoke 57 is alternately driven by the drive plates 27 and 29.

The electrically powered operator 13 further includes a coupling 85 which couples the handle 9 of the second electric power switch 5 to the handle 7 of the first switch 3. This coupling 85 includes an elongated member, such as the flat strap 87 which has a first opening 89 sized to engage the collar 67 on the first yoke 57. A second opening 91 in the strap 87 is positioned and sized to engage the collar 93 on a second yoke 95 which engages the second handle 9 on the second switch 5. This second yoke 95 also engages and slides along an escutcheon (not shown) on the molded housing 97 of the second switch 5. The same part can be used for the yoke 95 as the yoke 57 to reduce the parts count, although the camming surfaces 83 are not utilized on the second yoke 95.

Referring to FIG. 1, the flat strap 87 extends through a slot 99 in the flange 29*b* of the armature drive plate 29 which serves as a guide for the strap 87 and prevents it from lifting up off of the collar 67 on the yoke 57. A bracket 107 integrally formed on mounting plate 109 on the second switch 5 holds the strap 87 down and in engagement with the collar 93 of the second yoke 95.

The operation of the transfer switch 1 is as follows:

Prior to energization of the single action solenoid 17, the electromagnet drive plate 27 and the armature drive plate 29 are biased by the helical compression springs 53 to their outermost limit positions against the end flanges 35 of the mounting plate 31. If the first handle 7 is in the OFF position, as shown in FIGS. 2–4, the armature drive plate 29 is in engagement with the yoke 57 through slot 29*e* in the base 29*a*. At the same time, the second handle 9 of the second switch 5 is in the ON position, as shown in FIG. 5 as, it will be recalled, they are oppositely oriented end to end. Upon actuation of the single action solenoid 17, the electromagnet drive plate 27 is rapidly moved into engagement with the electromagnet drive plate stops 77 which restrict further movement of the electromagnet drive plate 27. However, as the armature 25 is rapidly pulled into the coil 21, the armature drive plate 29 slides along the mounting plate 31 resulting in the movement of the yoke 57 which, in turn, carries the handle 7 with it.

Figure 7:
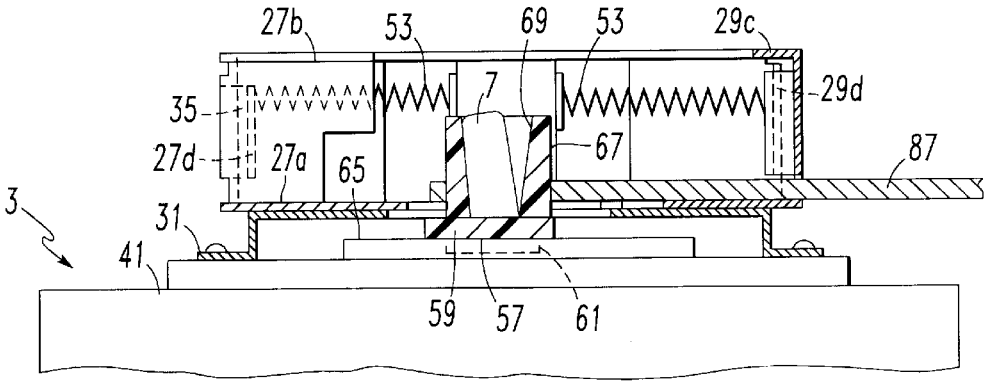
FIG. 7 is a vertical section taken through the mechanical assembly in FIG. 6 along the line 7—7.

As the handle 7 passes the toggle point of the switch 3, it rapidly travels to the ON position bringing the yoke 57 with it. When the camming surfaces 83 on the yoke 57 pass the pivots 81 on the latch arms, the latch arms 73 rapidly toggle to the position, shown in FIGS. 6 and 7, wherein the stops 79 are in position to engage the armature drive plate 29. As the handle 7 of the switch 3 moves to the ON position, the handle 9 of the second switch 5 is moved from the ON position to the OFF position. The operating mechanisms of the switches 3 and 5 are such that the switch 5 toggles OFF before the switch 3 is toggled ON so that there is a dead period in which both switches are OFF.

The next time the solenoid 17 is energized and the armature 25 is pulled into the coil 21, the armature drive plate 29 is restrained by the stops 79. Hence, the electromagnet, in effect, moves toward the armature, thereby pulling the electromagnet drive plate 27 with it. This electromagnet drive plate 27 engages the yoke 57, thereby pushing the handle 7 back toward the OFF position. Simultaneously, the strap 87 being in engagement with the collar 93 on the second yoke 95 moves the handle 9 of the second switch 5 toward the ON position. Again, the switch 3 toggles OFF before the switch 5 is toggled ON to provide an open switching transition. As the camming surfaces 83 on the first yoke 57 pass the pivot rivets 81, the arms 73 toggle rapidly to rotate the stops 77 in position for engaging the electromagnet drive plate 27 the next time the solenoid 17 is energized.

The solenoid 17 provides rapid operation of the transfer switch 1. The mechanical assembly 26 allows a single action solenoid to be used, as the latch mechanism alternately reverses the single motion of the solenoid for turning the switches OFF and ON.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A transfer switch, comprising:

first and second electric power switches having first and second operating handles, respectively, reciprocal in a common plane between ON and OFF positions;

an electrically powered operator, comprising:

a solenoid;

a mechanical assembly coupling the solenoid to the first handle of the first electric power switch for reciprocating the first handle between the ON and OFF positions on successive actuations of the solenoid;

a coupling coupling the handle of the second electric power switch to the mechanical assembly for movement with the first handle to reciprocate the second handle between the OFF position and the ON position opposite to the OFF position and the ON position of the first handle;

wherein the first and second electric power switches are mounted end to end with the first and second operating handles oppositely reciprocal in a common plane between the ON and OFF positions, and the coupling comprises an elongated member coupling the handle of the second electric power switch to the mechanical assembly; and wherein the solenoid comprises a single action solenoid having an electromagnet and an armature movable relative to the electromagnet, the mechanical assembly comprises a first drive member coupled to the electromagnet, a second drive member coupled to the armature, a latch mechanism reciprocal between a first latch position in which the first drive member is held fixed and the second drive member moves upon actuation of the single action solenoid and a second latch position in which the second drive member is held fixed and a first drive member moves upon actuation of the single action solenoid and a first yoke engaging the first handle and reciprocating the first handle between the ON and OFF positions on successive actuations of the single action solenoid through alternate engagement by one and then the other of the first and second drive members, the first yoke engaging and toggling the latch mechanism as the first handle reciprocates between the ON and OFF positions, and the elongated member being coupled to the first yoke.

2. An electrically powered operator for first and second power switches mounted end to end and having a first operating handle and a second operating handle, respectively, oppositely reciprocal in a common plane between ON and OFF positions, said operator, comprising:

a solenoid;

a mechanical assembly coupling the solenoid to the first operating handle of the first electric power switch for reciprocating the first operating handle between the ON and OFF positions on successive actuations of the solenoid;

a coupling comprising an elongated member coupling the second operating handle of the second electric power switch to the mechanical assembly for movement with the first operating handle to reciprocate the second operating handle between the OFF position and the ON position opposite the ON position and the OFF position of the first operating handle; and wherein the solenoid is a single action solenoid having an electromagnet and an armature movable relative to the electromagnet, and the mechanical assembly comprises a first drive member coupled to the electromagnet and a second drive member coupled to the armature, a latch mechanism reciprocal between a first latch position in which the first drive member is held fixed and a second drive member moves upon actuation of the single action solenoid and a second latch position in which the second drive member is held fixed and the first drive member moves upon actuation of the single action solenoid, a first yoke engaging the first handle and reciprocating the first handle between the ON and OFF positions on successive actuations of the single action solenoid through alternate engagement of the first yoke by one and then the other of the first and second drive members, the first yoke engaging and toggling the latch mechanism as the first handle reciprocates between the ON and OFF positions, and the elongated member being coupled to the first yoke for movement with the first yoke.

3. The transfer switch of claim 1 wherein the coupling includes a second yoke coupling the elongated member to the second operating handle.

4. The transfer switch of claim 3 wherein the coupling includes a guide mounted on the second electric power switch guiding reciprocation of the elongated member and maintaining the second yoke in engagement with the second operating handle.

5. The transfer switch of claim 4 wherein the mechanical assembly includes a frame mounted on the first electric power switch and in which the first drive member and second drive member slide, the frame including a guide guiding reciprocal movement of the elongated member and maintaining the elongated member in engagement with the first operating handle.

6. The transfer switch of claim 5 wherein the guide of the mechanical assembly comprises a slot in the frame through which the elongated member extends between the first yoke and the second yoke.

7. The electrically powered operator of claim 2 wherein the coupling further includes a second yoke secured to the elongated member and engaging the second handle.

* * * * *